US006230593B1

(12) United States Patent
Hsieh

(10) Patent No.: US 6,230,593 B1
(45) Date of Patent: May 15, 2001

(54) HANDLE STRUCTURE FOR A SCREWDRIVER

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/377,484

(22) Filed: Aug. 20, 1999

(51) Int. Cl.[7] ..... B25B 23/16
(52) U.S. Cl. ..... 81/177.5
(58) Field of Search ..... 81/177.1, 177.2, 81/177.5, 177.6, 177.7, 177.8

(56) References Cited

U.S. PATENT DOCUMENTS 839,477 * 12/1906 Heller ..... 81/177.6
1,034,383 * 7/1912 Bronson ..... 81/177.5
2,870,809 * 1/1959 Feldman et al. ..... 81/177.5
5,069,091 * 12/1991 Bramsiepe et al. ..... 81/177.7

* cited by examiner

*Primary Examiner*—James G. Smith
*Assistant Examiner*—David B. Thomas
(74) *Attorney, Agent, or Firm*—Varndell & Varndell, PLLC

(57) ABSTRACT

A handle structure for a screwdriver, which includes a handle fixedly provided at one end of a blade, the handle having a longitudinal slot through two opposite sides of the periphery thereof, a pivot pin fixedly mounted in the handle across the longitudinal slot, and a handle plate turned about the pivot pin, the handle plate having a longitudinally extended, serrated slot coupled to the pivot pin for enabling the handle to be turned about the pivot pin and set between the non-operative position received in the longitudinal slot at the handle, and the operative position arranged perpendicular to the handle.

2 Claims, 11 Drawing Sheets

HANDLE STRUCTURE FOR A SCREWDRIVER

BACKGROUND AND SUMMARY OF THE INVENTION

The present invention relates to a handle structure for a screwdriver, and more particularly to such a handle structure which comprises a handle, and a handle plate turned about a pivot in the handle between a first position where the handle plate is received inside the handle, and a second position where the handle plate is turned out of the handle and set in a perpendicular position relative to the handle.

A regular screwdriver is generally comprised of a handle, and a blade having one end terminating in a tip and an opposite end fixedly connected to the handle. The handle is shaped like a cylinder having longitudinal flutes arranged around the periphery. When turning the screwdriver with the hand, the hand may slip on the handle if the hand is contaminated with a greasy substance or the like. FIG. 1 shows another prior art screwdriver, which comprises a substantially T-shaped handle. This T-shaped handle enables the user to positively apply twisting force to the workpiece. However, it is not comfortable to turn the T-shaped handle with the hand. When turning light duty screw members, it is not necessary to use a screwdriver having a T-shaped handle.

The present invention provides a handle structure for a screwdriver which has a handle plate pivoted to the handle body. The handle plate can be turned about a pivot in the handle body, and set between the non-operative position, where the handle plate is received in a longitudinal slot inside the handle, and the operative position, wherein the handle plate is turned out of the longitudinal slot and arranged perpendicular to the handle.

DETAILED DESCRIPTION OF THE PREFERRED EMBODIMENT

Figure 1:
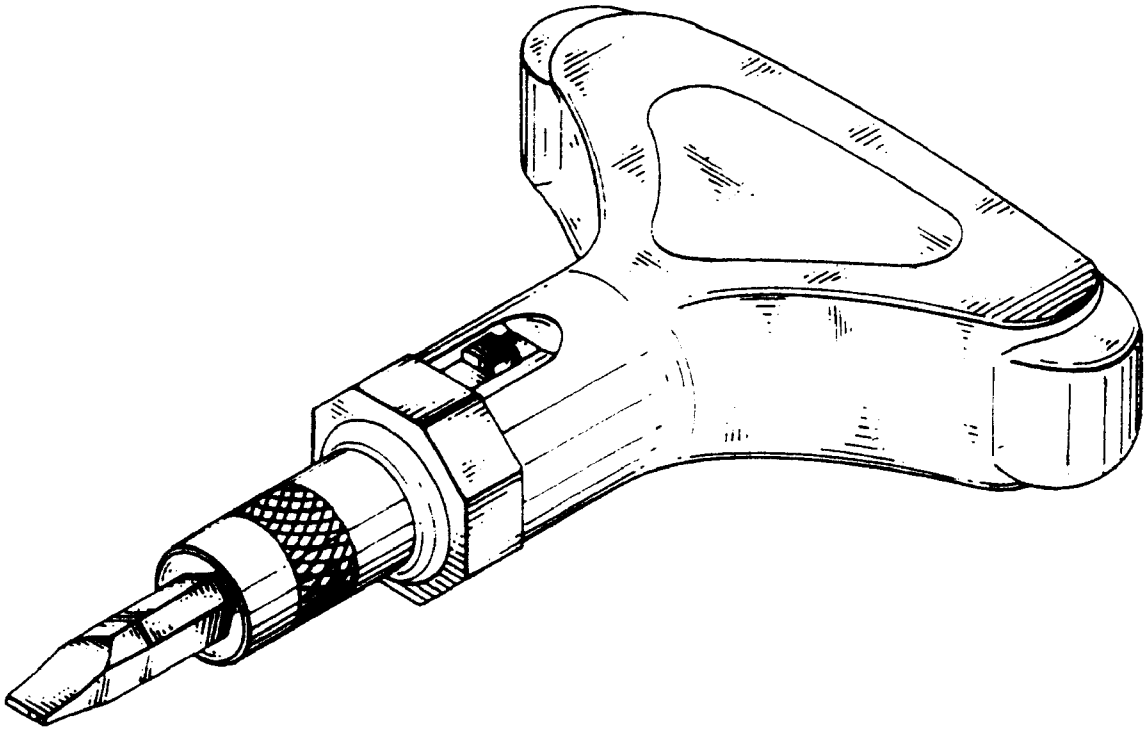
Fig. 1 PRIOR ART
FIG. 1 illustrate a conventional screwdriver.
Figure 2:
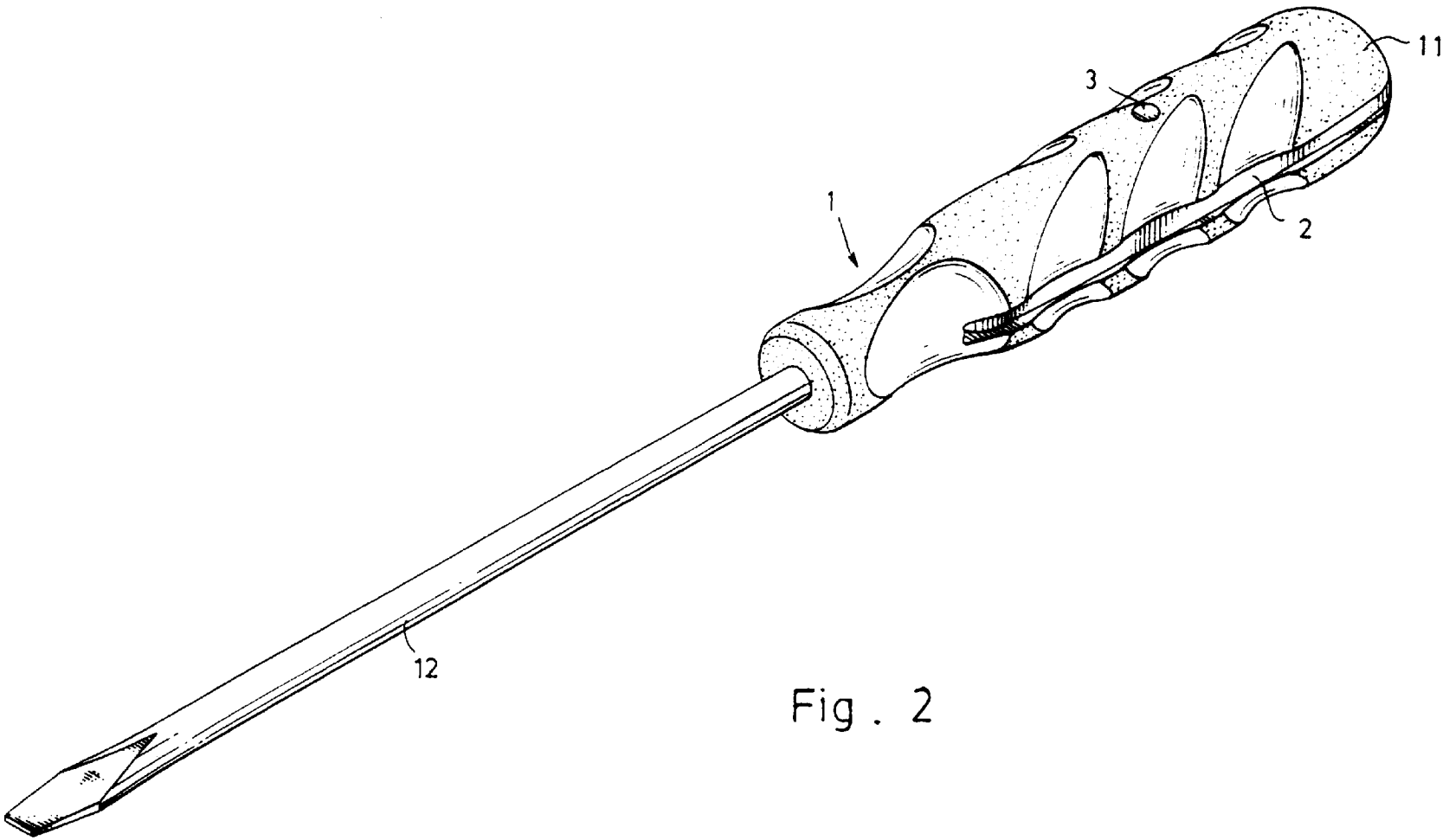
FIG. 2 is an elevational view of a screwdriver constructed according to a first embodiment of the present invention.
Figure 3:
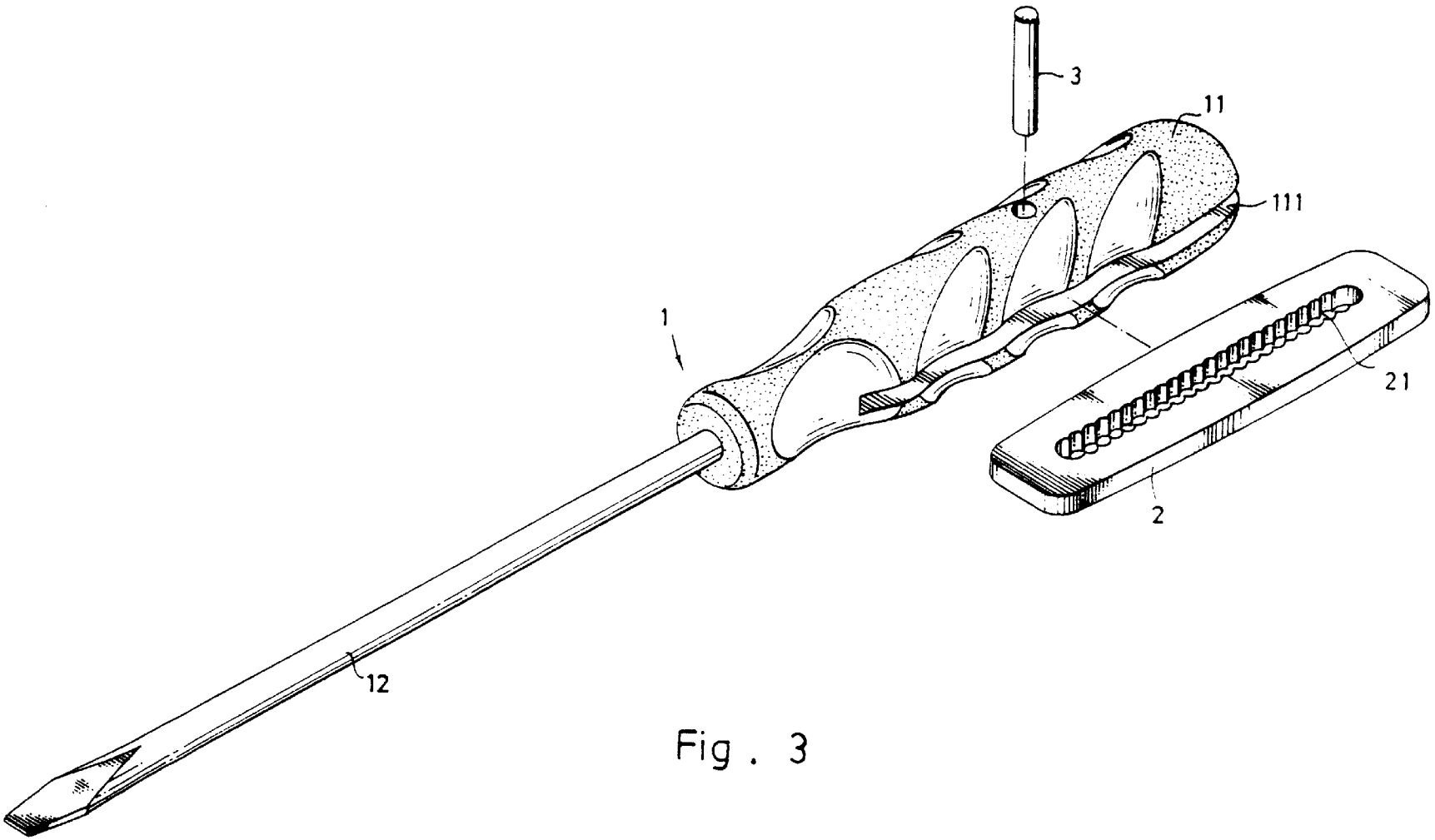
FIG. 3 is an exploded view the screwdriver shown in FIG. 2.

Referring to FIGS. 2 and 3, a screwdriver 1 is shown comprised of a blade 12, and a handle 11 fixedly provided at one end of the blade 12. The blade 12 can be designed having any of a variety of tips for turning a particular type of screws. The handle 11 comprises a longitudinal slot 111 through two opposite sides of the Periphery thereof, and a transverse pin hole 112 across the longitudinal slot 111. A handle plate 2 is received within the longitudinal slot 111 inside the handle 11, having a longitudinally extended, serrated slot 21. A pin 3 is inserted through the serrated slot 21 at the handle plate 2, and fixedly fastened to the pin hole 112 at the handle 11 to hold the handle plate 2 in place.

Figures 4, 5, 6:
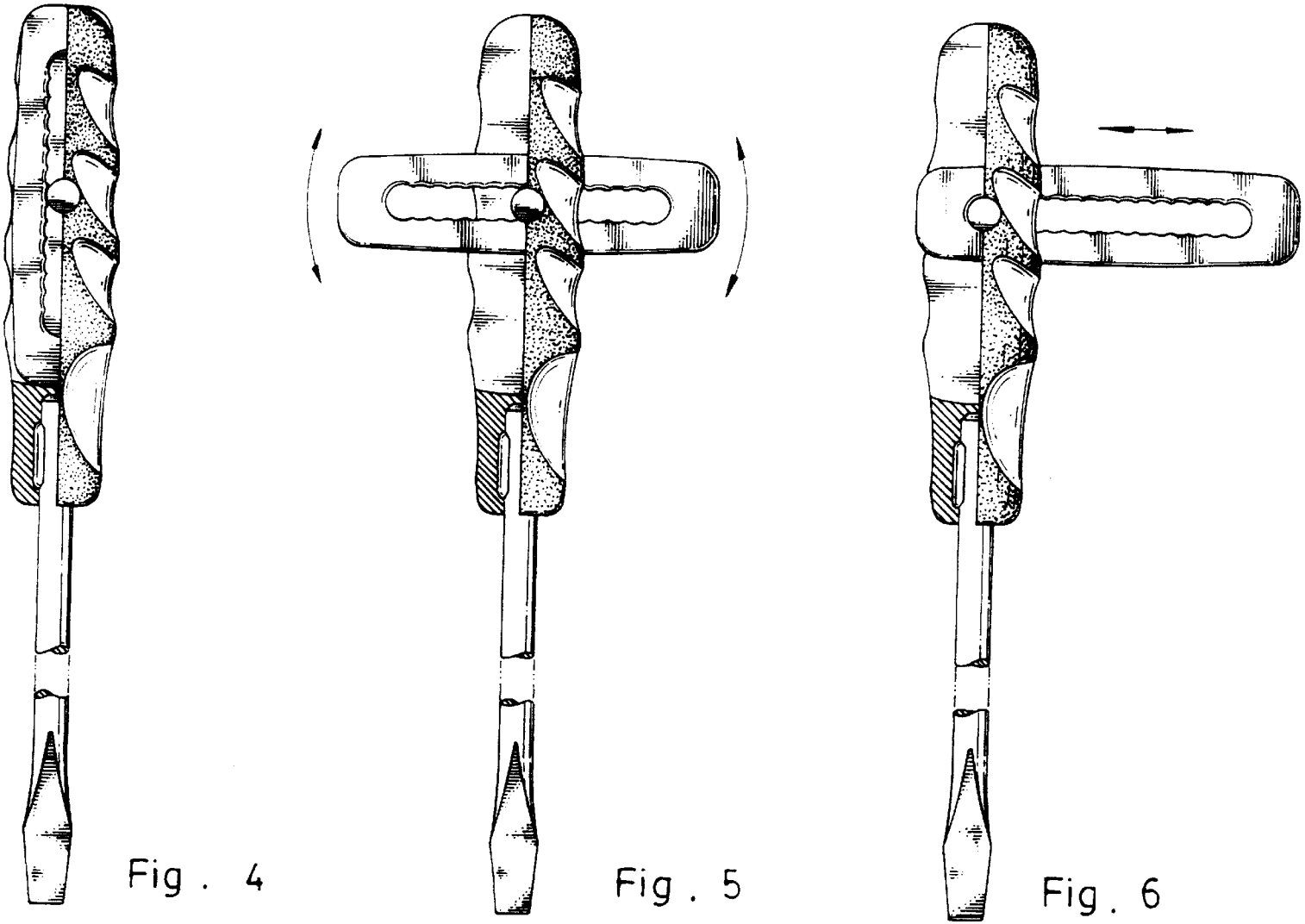
FIG. 4 illustrates one arrangement of the first embodiment of the present invention, where the handle plate is received in the longitudinal slot inside the hand.
FIG. 5 illustrates another arrangement of the first embodiment of the present invention, where the handle plate is turned out of the handle and set across the handle.
FIG. 6 illustrates still another arrangement of the first embodiment of the present invention, where the handle plate and the handle form a substantially T-shaped profile.

Referring to FIGS. 4 through 6 and FIG. 3 again, the handle plate 2 can be turned about the pin 3 and set in the non-operative position, wherein the handle plate 2 is received in the longitudinal slot 111 inside the handle 11 (as shown in FIG. 4). Alternatively, the handle plate 2 can be turned to the operative position shown in FIG. 5, or the operative position shown in FIG. 6. In FIG. 5, or the operative position shown in FIG. 6. In FIG. 5, the handle plate 2 and the handle 11 are arranged in a cross manner. In FIG. 6, the handle plate 2 and the handle 11 are arranged into a substantially T-shaped profile. When the handle plate 2 is maintained at the operation position shown in FIG. 5 or the operative position shown in FIG. 6, the user can positively and efficiently apply a twisting force to the screwdriver 1.

Figure 7:
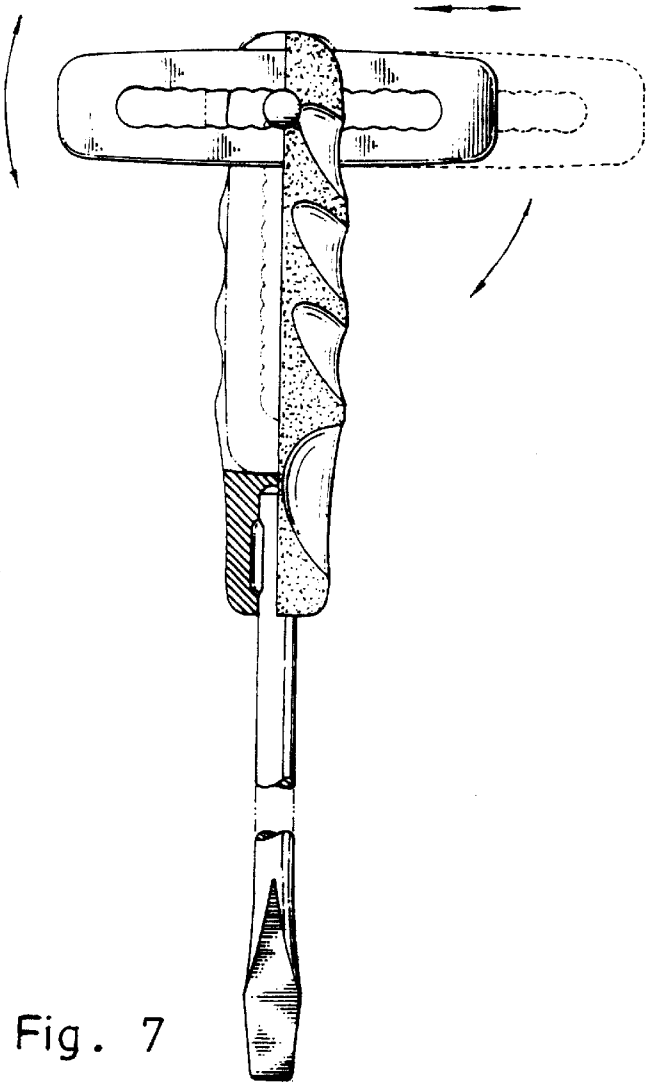
FIG. 7 illustrates the operation of a screwdriver constructed according to a second embodiment of the present invention.
Figure 8:
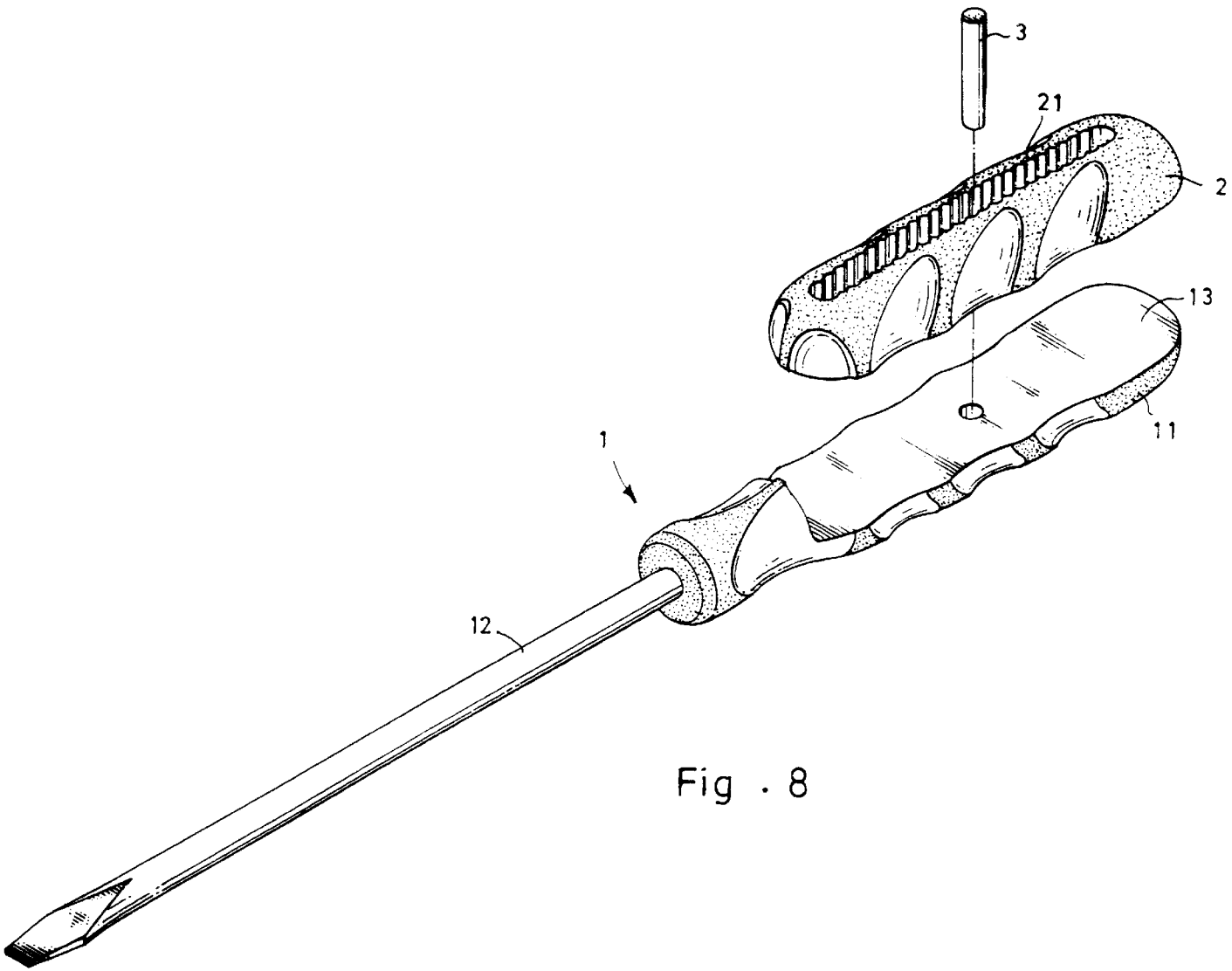
FIG. 8 is an exploded view of a screwdriver constructed according to a third embodiment of the present invention.
Figure 9:
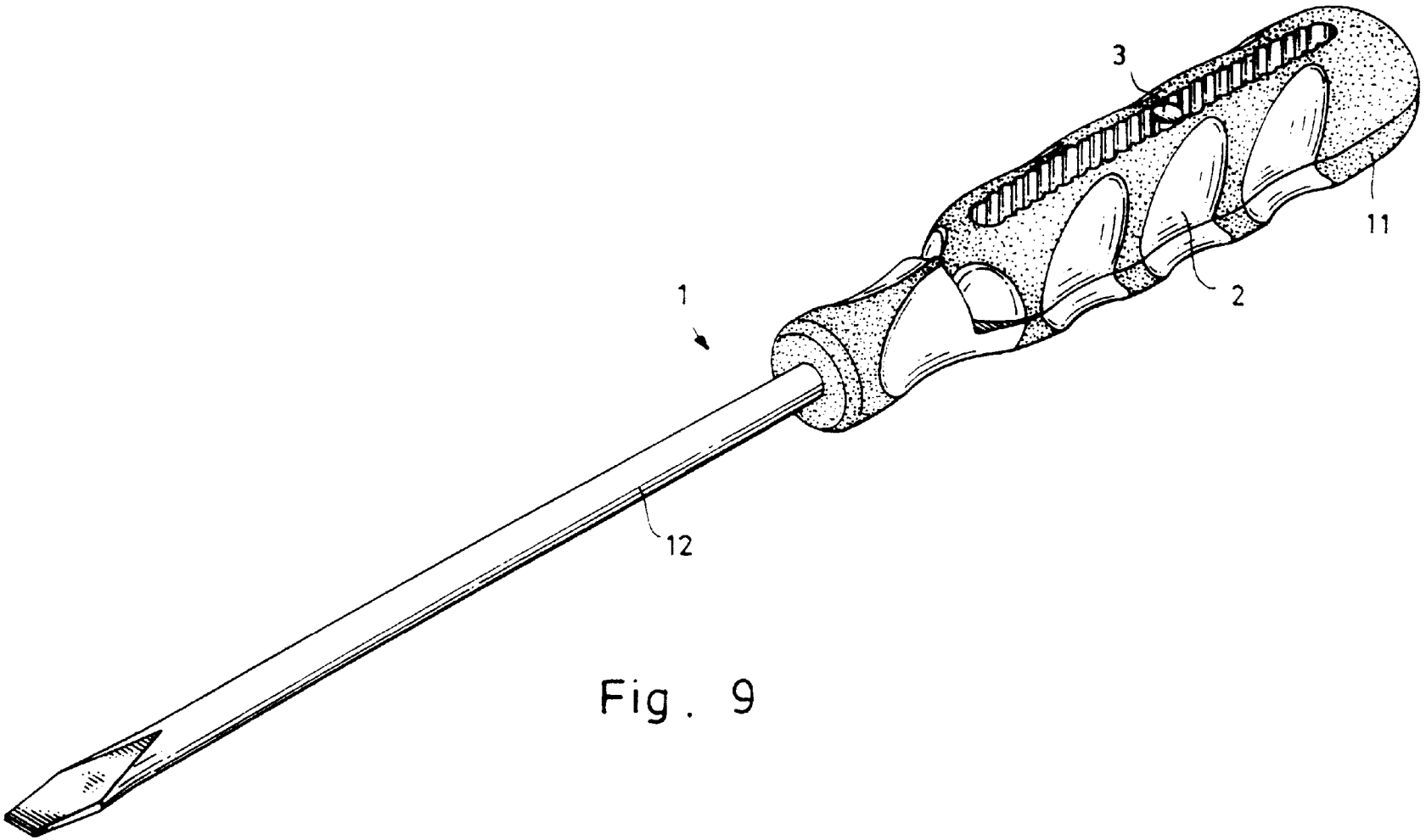
FIG. 9 is an elevational view of the screwdriver shown in FIG. 8.
Figure 12:
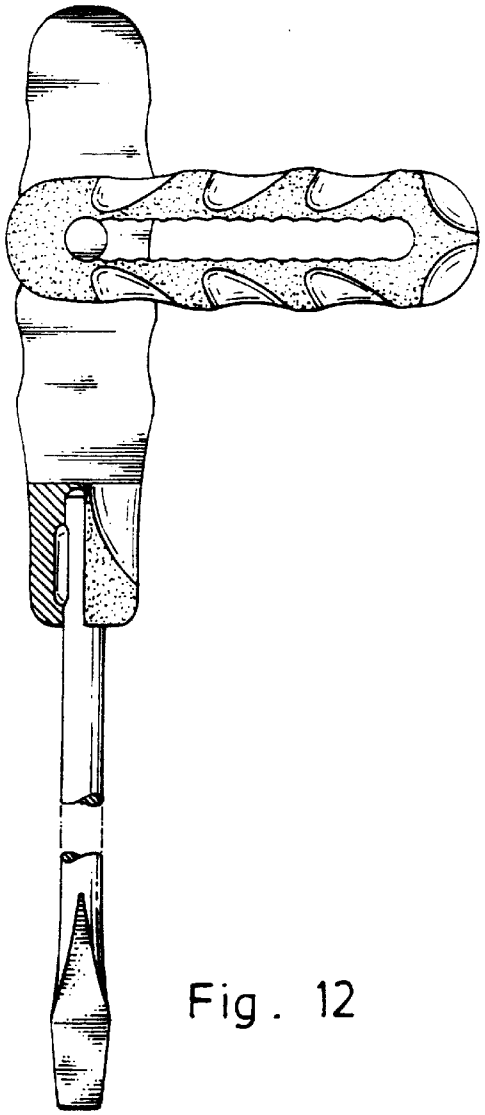
FIG. 12 illustrates still another arrangement of the third embodiment of the present invention, where the handle plate and the handle form a substantially T-shaped profile.
Figure 11:
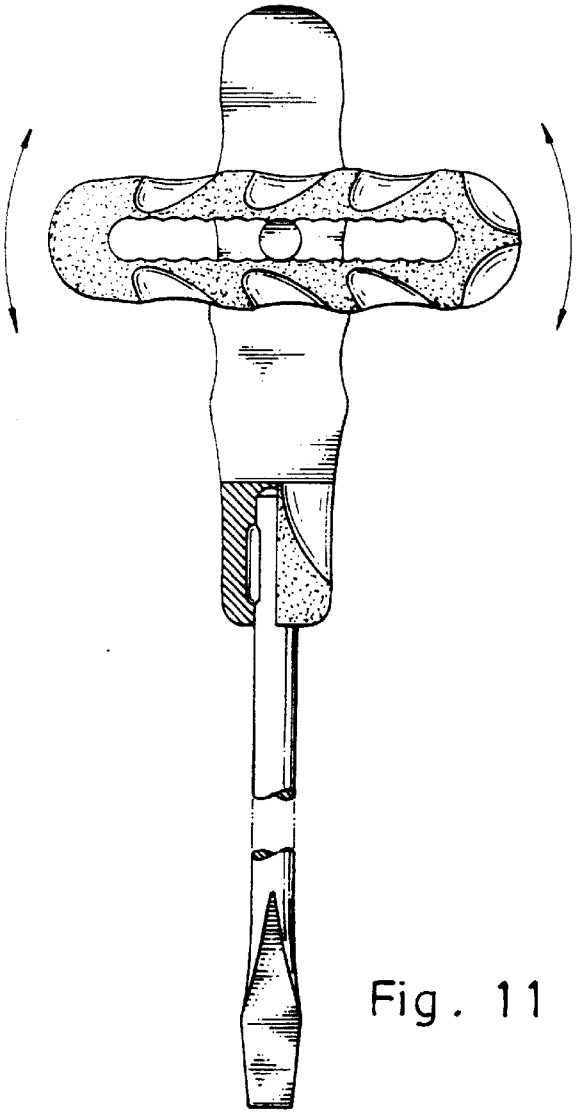
FIG. 11 illustrates another arrangement of the third embodiment of the present invention, where the handle plate is turned out of the handle and set across the handle.
Figure 10:
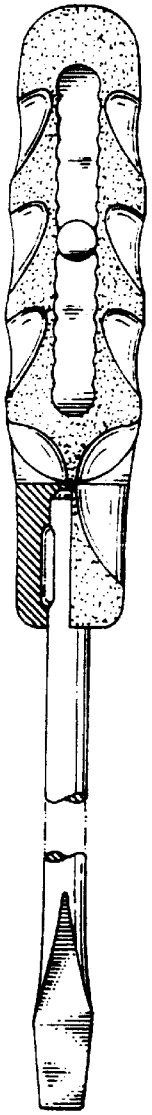
FIG. 10 illustrates one arrangement of the third embodiment of the present invention, where the handle plate is abutted against the flat recess at the handle.
Figure 13:
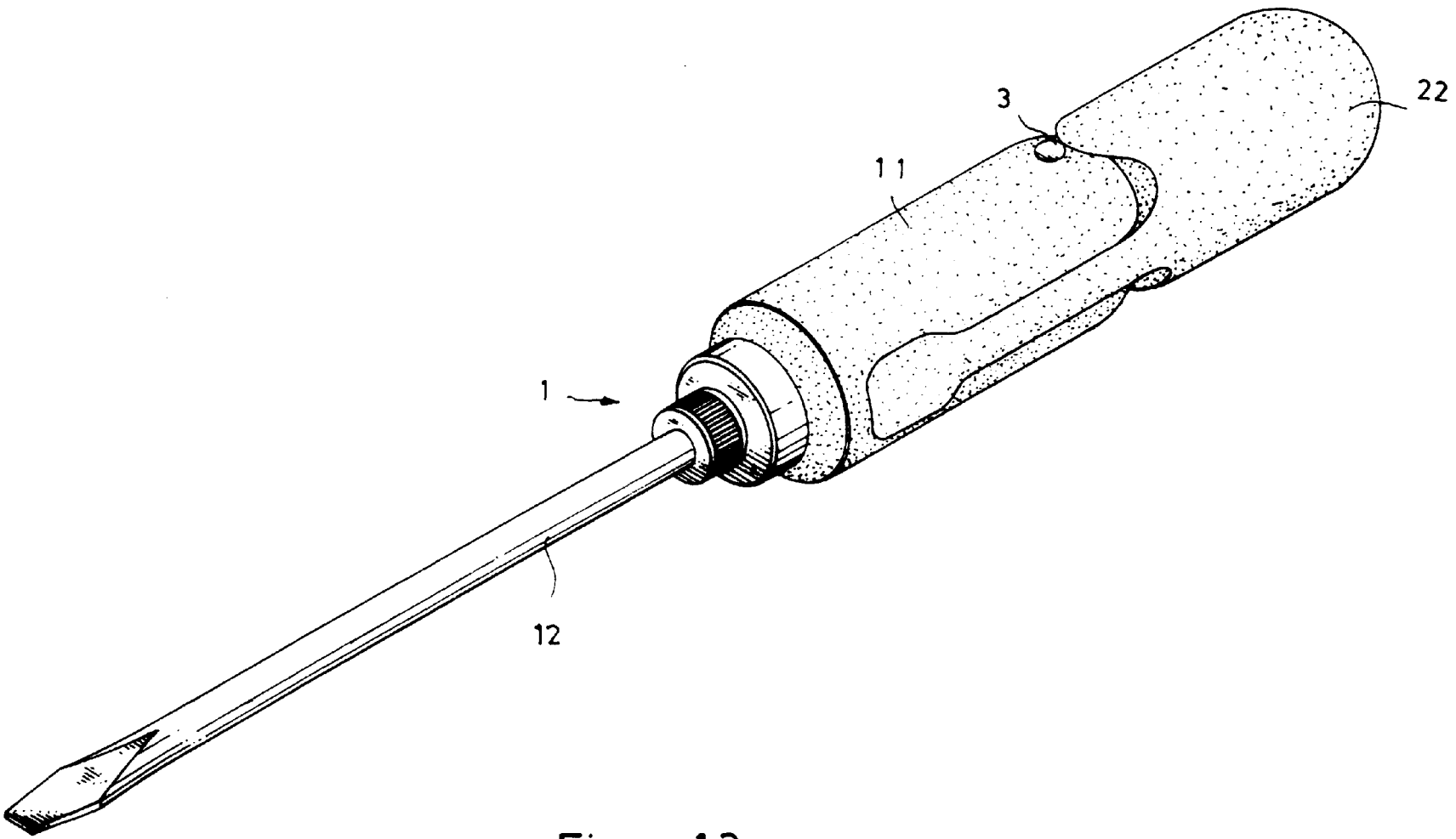
FIG. 13 is an elevational view of a screwdriver constructed according to a fourth embodiment of the present invention.
Figure 14:
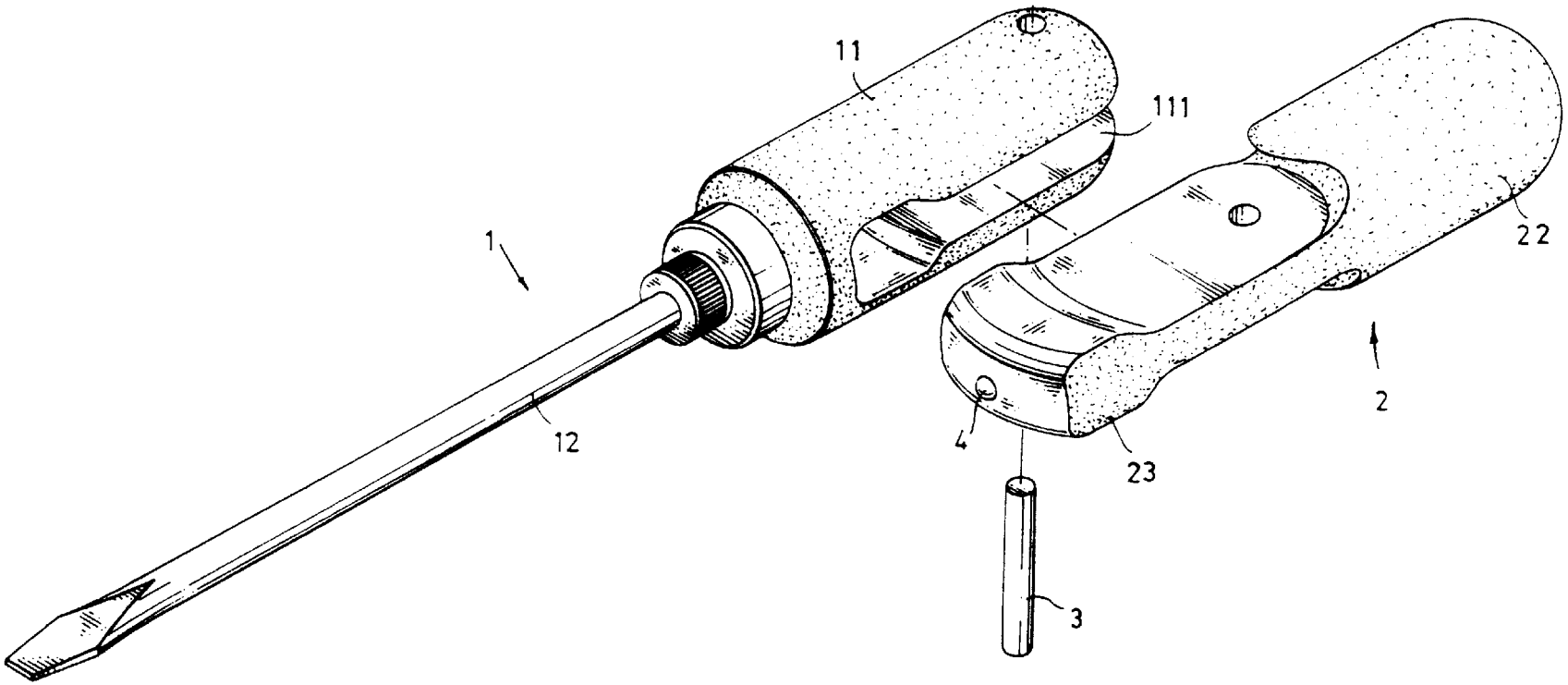
FIG. 14 is an exploded view of the screwdriver shown in FIG. 13.
Figure 15:
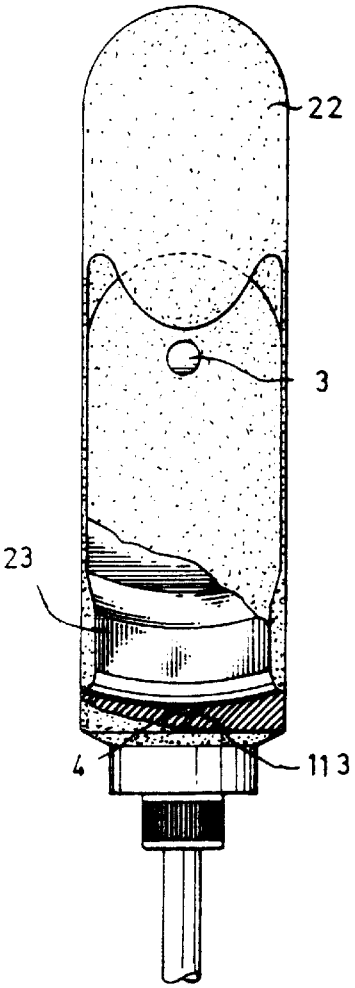
FIG. 15 illustrates one arrangement of the fourth embodiment of the present invention, where the flat coupling portion of the handle plate is received in the open slot at the handle.
Figure 16:
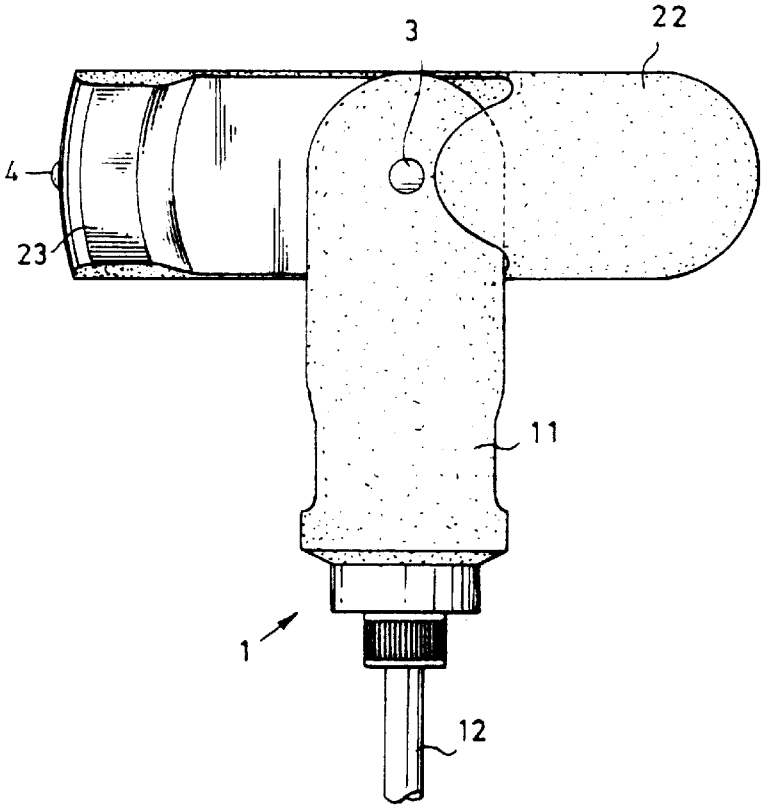
FIG. 16 illustrates another arrangement of the fourth embodiment of the present invention, where the flat coupling portion of the handle plate is turned out of the open slot at the handle, the handle plate and the handle form a T-shaped profile.

FIG. 7 shows an alternate form of the present invention. This embodiment is similar to the embodiment shown in FIGS. 2 through 6, with the exception of the location of the handle plate 2. According to this embodiment, the pin 3 holds the handle plate 2 near the top end (the end remote from the blade) of the handle 11.

FIGS. 8 through 12 shown another alternate form of the present invention. The screwdriver 1 according to this alternate form is also comprised of a blade 12, a handle 11 fixedly provided at one end of the blade 12, and a handle plate 2 pivoted to the handle 11 by a pin 3. The handle 11 has a longitudinal extended, flat recess 13. The handle plate 2 fits over the flat recess 13 at the handle 11, having a longitudinally extended, serrated slot 21, which receives the pin 3. similar to the embodiment shown in FIGS. 2 through 6, the handle plate 2 can be turned about the pin 3, and set in one of the positions shown in FIGS. 10 through 12.

FIGS. 13 through 16 show still another alternate form of the present invention. The screwdriver 1 according to this alternate form is also comprised of a blade 12, a handle 11 fixedly provided at one end of the blade 12, and a handle plate 2 pivoted to the handle 11 by a pin 3. The handle 11 is shaped like a fork defining an open slot 111. The handle plate

2 has a cylindrical handhold portion 22 at one end, and a flat coupling portion 23 at an opposite end. The flat coupling portion 23 fits the open slot 111, and is pivoted to the handle 11 by the pin 3. Further, the handle 11 has a rounded recess 113 inside the open slot 111. The coupling portion 23 comprises a spring-supported ball 4 at its one end remote from the handhold portion 22. When the coupling portion 23 is turned with the handle plate 2 about the pin 3 to the inside of the open slot 111, the spring-supported ball 4 is engaged into the rounded recess 113 to hold the handle plate 2 in longitudinal alignment with the handle 11.

It is to be understood that the drawings are designed for purposes of illustration only, and are not intended as a definition of the limits and scope of the invention disclosed.

What is claimed is:

1. A handle structure for a screwdriver, comprising a handle fixedly provided at one end of a blade, said handle having a longitudinal slot through two opposite sides of the periphery thereof, a pivot pin fixedly mounted in said handle across said longitudinal slot, and a handle plate turned about said pivot pin, said handle plate having a longitudinal extended, serrated slot coupled to said pivot pin for enabling said handle to be turned about said pivot pin and moved axially relative to said pin to force one of two opposite ends of said longitudinally extended, serrated slot into engagement with said pivot pin, said handle plate having a size not greater than the longitudinal slot at said handle so that said handle plate can be received in the longitudinal slot at said handle.

2. A handle structure for a screwdriver, comprising a handle fixedly provided at one end of a blade, said handle having a longitudinally extended, flat recess, a pivot pin perpendicularly fastened to the flat recess at said handle, and a handle plate fitting over the flat recess at said handle and turned about said pivot pin, said handle plate having a longitudinally extended, serrated slot coupled to said pin.

* * * * *